US005206631A

United States Patent [19]

Yamamoto et al.

[11] Patent Number: 5,206,631

[45] Date of Patent: Apr. 27, 1993

[54] METHOD AND APPARATUS FOR DRIVING A CAPACITIVE FLAT MATRIX DISPLAY PANEL

[75] Inventors: Kyoichi Yamamoto, Yamatokooriyama; Shigeyuki Harada, Nara; Atsushi Sakamoto, Nara; Toshihiro Ohba, Nara; Hiroshi Kishishita, Nara, all of Japan

[73] Assignee: Sharp Kabushiki Kaisha, Osaka, Japan

[21] Appl. No.: 688,144

[22] Filed: Apr. 22, 1991

[30] Foreign Application Priority Data

Apr. 25, 1990 [JP] Japan ..... 2-111375

[51] Int. Cl.[5] ..... G09G 3/30

[52] U.S. Cl. ..... 340/781; 315/169.3; 340/805; 340/811

[58] Field of Search ..... 340/781, 760, 805, 811, 340/825.11; 315/169.3

[56] References Cited

U.S. PATENT DOCUMENTS

| | | | |
|---|---|---|---|
| 4,691,144 | 9/1987 | King et al. | 315/169.3 |
| 4,864,182 | 9/1989 | Fujioka et al. | 315/169.3 |
| 4,866,348 | 9/1989 | Harada et al. | 340/781 |
| 4,872,059 | 10/1989 | Shinabe | 340/784 |
| 4,935,671 | 6/1990 | Harada et al. | 315/169.3 |
| 4,951,041 | 8/1990 | Inada et al. | 340/767 |
| 4,962,374 | 10/1990 | Fujioka et al. | 340/781 |
| 5,006,838 | 4/1991 | Fujioka et al. | 340/781 |
| 5,018,834 | 5/1991 | Birch | 340/805 |
| 5,047,758 | 9/1991 | Hartmann et al. | 340/784 |
| 5,093,655 | 3/1992 | Tanioka et al. | 340/784 |
| 5,122,790 | 6/1992 | Yasuda et al. | 340/784 |

FOREIGN PATENT DOCUMENTS

| | | |
|---|---|---|
| 0242468 | 4/1986 | European Pat. Off. . |
| 3823061 | 7/1988 | Fed. Rep. of Germany . |

*Primary Examiner*—Tommy Chin
*Assistant Examiner*—A. Au
*Attorney, Agent, or Firm*—Nixon & Vanderhye

[57] ABSTRACT

In a display device having a plurality of scanning-side electrodes arranged in one direction, a plurality of data-side electrodes arranged in a second direction intersection the first direction, and dielectric layers interposed therebetween, a modulated voltage the magnitude of which is varied according to the emission or non-emission of light is applied to the data-side electrodes, while applying a write voltage in line sequential fashion to the scanning-side electrodes, thereby performing the display control. In such a display device, the polarity of the voltage applied between the data-side electrode and the scanning-side electrode corresponding to the picture element to be driven for light emission is reversed one or more times during the period in which the write voltage is being applied to the scanning-side electrode. This serves to reduce the modulated voltage and the write voltage, thus contributing to the reduction in power consumption. Even when the modulated voltage or the write voltage is reduced, the desired brightness of emitted light can be obtained. In the case of not lowering the modulated voltage or the write voltage, it is possible to further enhance the brightness of emitted light.

17 Claims, 9 Drawing Sheets

METHOD AND APPARATUS FOR DRIVING A CAPACITIVE FLAT MATRIX DISPLAY PANEL

BACKGROUND OF THE INVENTION

1. Field of the Invention

The present invention relates to a driving method and a driving device for a display device such as an electroluminescence (abbreviated as EL) display device or other AC driven capacitive flat matrix display panel (hereinafter referred to as the "thin-film EL display device").

2. Description of the Prior Art

For example, a double insulation (or three-layered) thin-film EL element is constructed in the following manner.

As shown in FIG. 1, strips of transparent electrodes 2 composed of $In_2O_3$ are formed parallel to one another on a glass substrate 1. Then, a dielectric layer 3 composed of $Y_2O_3$, $Si_3N_4$, $TiO_3$, or $Al_2O_3$, an EL layer 4 composed of ZnS or other material doped with an activating agent such as Mn, and another dielectric layer 3*a* composed of $Y_2O_3$, $Si_3N_4$, $TiO_3$, or $Al_2O_3$, each layer having a thickness of 500 to 1,000 Å, are deposited one on top of another above the transparent electrodes 2 using a thin-film technique such as evaporation or sputtering, to form a three-layered construction. Finally, strips of counter electrodes 5 composed of Al are formed parallel to one another, and at right angles to the transparent electrodes 2, on top of the three-layered construction.

The thus constructed thin-film EL element can be considered as a capacitive element in terms of circuit equivalence since the EL layer 4 sandwiched between the dielectric layers 3 and 3*a* is interposed between the electrodes. As is obvious from the voltage-to-brightness characteristic curve indicated by the reference sign a0 in FIG. 2, the thin-film EL element is driven by a relatively high voltage on the order of 200 V.

In a thin-film EL display device using the above thin-film EL element for a display panel, either the transparent electrodes 2 or the counter electrodes 5 of the thin-film EL element are configured as the scanning-side electrodes and the other as the data-side electrodes, the driving of the display being performed in such a way that a write voltage is applied to the line-sequentially selected scanning-side electrodes by a scanning-side driving circuit consisting of n-channel high voltage MOS (Metal Oxide Semiconductor) driver ICs (integrated circuits) and p-channel high voltage MOS driver ICs, while applying a modulated voltage, which determines emission or non-emission of light according to the display data, to the data-side electrodes by a data-side driving circuit consisting of n-channel high voltage MOS driver ICs and p-channel high voltage MOS driver ICs.

For driving the display, considering that the thin-film EL element is a capacitive element, an AC driving method is employed in which the p-channel driving to apply a write voltage of positive polarity and the n-channel driving to apply a write voltage of negative polarity to the scanning-side electrodes with respect to the ground potential such as the chassis are alternately performed for every frame.

FIG. 3 is a circuit diagram showing an example of the configuration of a thin-film display device in which the prior art driving method is employed. In the display device shown, a thin-film EL element having an emitting threshold voltage Vw (=190 V) is used for a display panel 10, in which the data-side electrodes are arranged in the X direction and the scanning-side electrodes are arranged in the Y direction.

Scanning-side n-channel high voltage MOS driver ICs 20, 30 and scanning-side p-channel high voltage MOS driver ICs 40, 50 are the circuits constituting the above-mentioned scanning-side driving circuit.

On the other hand, a data-side driver IC 160 is the circuit that constitutes the above-mentioned data-side driving circuit.

A source potential switching circuit 80A is a circuit for switching the source potential for all p-channel MOS transistors PT1–PTi in the p-channel high voltage MOS driver ICs 40, 50 between a positive-polarity write voltage $Vw+\frac{1}{2}Vm$ (=220 V) and a voltage of 0 V.

A source potential switching circuit 90A is a circuit for switching the source potential for all n-channel MOS transistors NT1–NTi in the n-channel high voltage MOS driver ICs 20, 30 between a negative-polarity write voltage $-(Vw-\frac{1}{2}Vm)$ (= −160 V) and a voltage of 0 V.

A data inverting circuit 100 is a circuit comprising an exclusive OR gate, etc. for inverting a data signal DATA, which is input to the data-side driver IC 160, in response to a control signal RVC1.

According to the prior art driving method employed in the above thin-film EL display device, a voltage Vw (= +190 V) approximately equal to the emitting threshold voltage is added to a constant voltage $\frac{1}{2}Vm$ to provide a voltage of $Vw+\frac{1}{2}Vm$ as the write voltage for the p-channel driving, while a negative-polarity constant voltage $-(Vw-\frac{1}{2}Vm)$ is provided as the write voltage for the n-channel driving. In this case, the voltage Vm is set at 60 V. Therefore, the write voltage for the p-channel driving is given by:

$$Vw+\tfrac{1}{2}Vm=190V+\tfrac{1}{2}\times 60V=220V \quad (1)$$

and the write voltage for the n-channel driving is given by:

$$-(Vw-\tfrac{1}{2}Vm)=-190V+\tfrac{1}{2}\times 60=-160V \quad (2)$$

As regards the modulated voltage, 0 V is set for the p-channel driving, and Vm (=60 V) for the n-channel driving, as the modulated voltage for light emission, while Vm (=60 V) is set for the p-channel driving, and 0 V for the n-channel driving, as the modulated voltage for non-emission of light. Therefore, the voltage given by the following equation is applied to the picture elements for light emission during the p-channel driving, with the potential of the scanning-side electrodes as the reference.

$$Vw+\tfrac{1}{2}Vm-0V=190V+\tfrac{1}{2}\times 60V=220V \quad (3)$$

The voltage applied during the n-channel driving is given by:

$$-(Vw-\tfrac{1}{2}Vm)-Vm=-(Vw+\tfrac{1}{2}Vm)=-(190V+30V)=-220V \quad (4)$$

On the other hand, the voltage given by the following equation is applied for non-emission of light during the p-channel driving.

$$Vw+\frac{1}{2}Vm-Vm=Vw-\frac{1}{2}Vm=190-30V=160V \quad (5)$$

The voltage applied during the n-channel driving is given by:

$$-(Vw-\frac{1}{2}Vm)-0V=-(Vw-\frac{1}{2}Vm)=-(190V-30V)=-160V \quad (6)$$

In FIG. 2, the voltages Vw, (Vw+½Vm), and (Vw−½Vm) are marked alongside of the corresponding voltage values on the x-axis along which the applied voltage is plotted.

Referring to FIG. 3, the display device shown is driven in response to externally supplied two synchronizing signals, a vertical synchronizing signal V and a horizontal synchronizing signal H. That is, the p-channel or the n-channel driving is performed on the scanning-side electrodes in line sequential fashion in synchronism with the horizontal synchronizing signal H, and one frame is formed when the line sequential driving of all the scanning electrodes is completed. The vertical synchronizing signal V usually indicates the beginning of one frame, and in synchronism with this signal, the driving for one frame is initiated. Each scanning-side electrode is subjected in line sequential fashion to the p-channel or the n-channel driving once during one frame period. The EL display element 10 requires the applied voltage to alternate, and the p-channel driving and the n-channel driving are performed alternately in such a way that the alternating current cycle is closed with two frames for every scanning-side electrode. To achieve this, there have been proposed a method (field inversion driving) in which all scanning-side electrodes are subjected in line sequential fashion to driving of one polarity in one frame period, and a method (line inversion driving) in which the driving is performed by inverting the polarity for every scanning line.

However, since the thin-film EL element is a capacitive element as described earlier, a modulating voltage of OV or Vm according to the display data is applied to all the data-side electrodes X, repeating charge and discharge every time each scanning-side electrode Y is selectively driven in line sequential fashion; therefore, the thin-film EL element has the problem of consuming a large amount of modulation power.

Generally, in a capacitive element of capacitance C, when charge and discharge is repeated f times per unit time with a charge voltage V, the power consumption P is given by:

$$P=f\cdot C\cdot V^2 \quad (7)$$

Therefore, in the above-described prior art driving method, when the capacitance of the display panel 10 is denoted as C and the number of times to apply the modulated voltage Vm to the data-side electrodes X per unit time is denoted as f, the power consumption by the charging and discharging of the modulated voltage Vm, i.e. the modulation power Pm, is given by:

$$Pm=f\cdot C\cdot Vm^2 \quad (8)$$

Aiming at overcoming this problem, there have been proposed various driving methods including a step driving method in which the magnitude (voltage level) of the modulated voltage Vm is increased stepwise, but any of the thus far proposed methods has not been able to sufficiently reduce the modulation power.

When a write voltage is being applied to a certain scanning-side electrode Y, for example, Y1, the transistors PT2–PT1 and NT2–NTi for the remaining scanning-side electrodes Y2–Yi are turned off, and consequently, the remaining scanning-side electrodes Y2–Yi are placed in the so-called floating state. Therefore, the display power P associated with the capacitance C at the scanning-side electrode Y1 to which the write voltage is applied is relatively small. On the other hand, the modulated voltage 0 V or Vm is constantly applied to the data-side electrodes X, as described earlier, resulting in a large modulation power Pm because of the capacitance C between all the data-side electrodes X and all the scanning-side electrodes Y. Therefore, reduction in the modulation power Pm is effective for reducing the display power for the entire display device.

SUMMARY OF THE INVENTION

It is an object of the invention to provide a driving method and a driving device for a display device, that can achieve a significant reduction in the modulation power.

The invention provides a driving method for a display having a plurality of scanning-side electrodes extending in one direction, a plurality of data-side electrodes extending in a second direction intersecting the first direction, and dielectric layers interposed therebetween, picture elements being formed at intersections of the scanning-side electrodes and data-side electrodes, the picture elements being driven by applying a modulated voltage, the magnitude thereof being varied according to the emission or non-emission of light, to the data-side electrodes, while applying a write voltage in line sequential fashion to the scanning-side electrodes, so that a voltage exceeding the emitting threshold voltage of the picture element is applied thereto for emission of light and a voltage below the emitting threshold voltage is applied for non-emission of light, the method comprising: reversing the polarity of the voltage applied between the data-side electrode and the scanning-side electrode corresponding to the picture element to be driven for light emission, one or more times during the period in which the write voltage is being applied to the scanning-side electrode.

According to the invention, the display device such as an EL panel has a plurality of scanning-side electrodes and a plurality of data-side electrodes arranged intersecting each other in a matrix form with dielectric layers interposed therebetween; a modulated voltage is applied to the data-side electrodes, a write voltage is applied in line sequential fashion to the scanning-side electrodes, and a prescribed voltage exceeding the emitting threshold voltage is applied to the intersection of the data-side electrode and the scanning-side electrode corresponding to the picture element to be driven for light emission. During the period in which the write voltage is being thus applied to each scanning electrode, the polarity of the voltage applied between the data-side electrode and the scanning-side electrode corresponding to the picture element to be driven for light emission is reversed one or more times. This serves to reduce the modulated voltage Vm required to obtain the desired brightness, thereby achieving the reduction of the modulation power Pm. It is also possible to reduce the write voltage applied to the scanning electrodes, which serves to reduce the power consumption during the driving of the scanning-side electrodes.

Furthermore, according to the invention, since the polarity of the voltage applied between the data-side electrode and the scanning-side electrode corresponding to the picture element to be driven for light emission is reversed one or more times during the period in which the write voltage is being applied to the scanning-side electrodes, the desired brightness of light emission can be provided even when the modulated voltage or the write voltage is reduced, or in the case of not reducing the modulated voltage or the write voltage, it is possible to further enhance the brightness of light emission.

As described, with the driving method for a display device according to the invention, a modulated voltage is applied to the data-side electrodes, a write voltage is applied in line sequential fashion to the scanning-side electrodes, and a voltage exceeding the emitting threshold voltage is applied to the intersection of the data-side electrode and the scanning-side electrode at which the picture element to be driven for light emission is formed, the polarity of the voltage applied between the data-side electrode and the scanning-side electrode corresponding to the picture element to be driven for light emission being reversed one or more times during the period in which the write voltage is being applied to the scanning side electrode. This serves to reduce the modulated voltage Vm and achieve a reduction in the modulation power, which allows the use of a low voltage circuit for the data-side driving circuit for reduction of costs.

Also, the reduction in the modulation power permits a higher packing density of the data-side driving circuit constructed with integrated circuits, which contributes to the reduction in the size of the display device.

Furthermore, according to the invention, since the polarity of the voltage applied between the data-side electrode and the scanning-side electrode corresponding to the picture element to be driven for light emission is reversed one or more times, it is possible to obtain high brightness even when the modulated voltage or the write voltage is reduced.

The invention also provides a driving device for a display device having a plurality of scanning-side electrodes, a plurality of data-side electrodes, and dielectric layers interposed therebetween, picture elements being formed at intersections of the scanning-side electrodes and data-side electrodes, comprising: scanning-side electrode driving means connected to the plurality of scanning-side electrodes for applying a positive or negative polarity write voltage to the scanning-side electrodes; data-side electrode driving means connected to the plurality of data-side electrodes, which, when a picture element on the scanning-side electrode supplied with the write voltage is to be driven for light emission, applies a voltage, which cooperates with each write voltage to set a voltage applied to picture element above a threshold voltage, to the corresponding data-side electrode, and when the picture element is not driven for light emission, applies a voltage, which cooperates with each write voltage to set a voltage applied to picture element below a threshold voltage, to the corresponding data-side electrode; and display control means for controlling the scanning-side electrode driving means and the data-side electrode driving means and reversing the polarity of the voltage applied between the data-side electrode and the scanning-side electrode corresponding to the picture element to be driven for light emission, one or more times during the period in which the write voltage is being applied to the scanning-side electrode.

The invention is characterized in that the scanning-side electrode driving means comprises: odd-numbered electrode driving circuits for applying the write voltage to the odd-numbered scanning-side electrodes; and even-numbered electrode driving circuits for applying the write voltage to the even-numbered scanning-side electrodes.

The invention is also characterized in that the scanning-side electrode driving means comprises; a first potential switching circuit for switching the voltage applied to the odd-numbered and even-numbered electrode driving circuits between a voltage of positive polarity and a voltage of 0 V; and a second potential switching circuit for switching the voltage applied to the odd-numbered and even-numbered electrode driving circuits between a voltage of positive polarity and a voltage of 0 V.

Furthermore, the invention is characterized in that the odd-numbered electrode driving circuits comprises: a first driving circuit for applying the voltage supplied from the first potential switching circuit to the scanning-side electrodes; and a second driving circuit for applying the voltage supplied from the second potential switching circuit to the scanning-side electrodes.

The invention is further characterized in that the even-numbered electrode driving circuits comprises: a third driving circuit for applying the voltage supplied from the first potential switching circuit to the scanning-side electrodes; and a fourth driving circuit for applying the voltage supplied from the second potential switching circuit to the scanning-side electrodes.

Also, the invention is characterized in that the first driving circuit comprises: a plurality of p-channel MOS transistors to the drains of which the scanning-side electrodes are connected and to the sources of which the first potential switching circuit is connected; and a first logic circuit to which the gates of the plurality of p-channel MOS transistors are connected and which applies a high level signal to the gate of the p-channel MOS transistor connected to the scanning electrode to be supplied with the write voltage.

Furthermore, the invention is characterized in that the second driving circuit comprises: a plurality of n-channel MOS transistors to the drains of which the scanning-side electrodes are connected and to the sources of which the second potential switching circuit is connected; and a second logic circuit to which the gates of the plurality of n-channel MOS transistors are connected and which applies a high level signal to the gate of the n-channel MOS transistor connected to the scanning electrode to be supplied with the write voltage.

Further, the invention is characterized in that the third driving circuit comprises: a plurality of p-channel MOS transistors to the drains of which the scanning-side electrodes are connected and to the sources of which the first potential switching circuit is connected; and a third logic circuit to which the gates of the plurality of p-channel MOS transistors are connected and which applies a high level signal to the gate of the p-channel MOS transistor connected to the scanning electrode to be supplied with the write voltage.

The invention is further characterized in that the fourth driving circuit comprises: a plurality of n-channel MOS transistors to the drains of which the scanning-side electrodes are connected and to the sources of which the second potential switching circuit is connected; and a fourth logic circuit to which the gates of the plurality of n-channel MOS transistors are connected and which applies a high level signal to the gate of the n-channel MOS transistor connected to the scanning electrode to be supplied with the write voltage.

Furthermore, the invention is characterized in that the data-side driving means comprises: a plurality of pull-up switching elements, one each provided for each data-side electrode, for applying the modulated voltage to the data-side electrodes; a plurality of pull-down switching elements, one each provided for each data-side electrode, for applying the reference voltage of 0 V to the data-side electrodes; and element control circuits for controlling the switching of the pull-up switching elements and pull-down switching elements for every one of the data-side electrodes in such a manner that when either one of the switching elements is on, the other is off.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
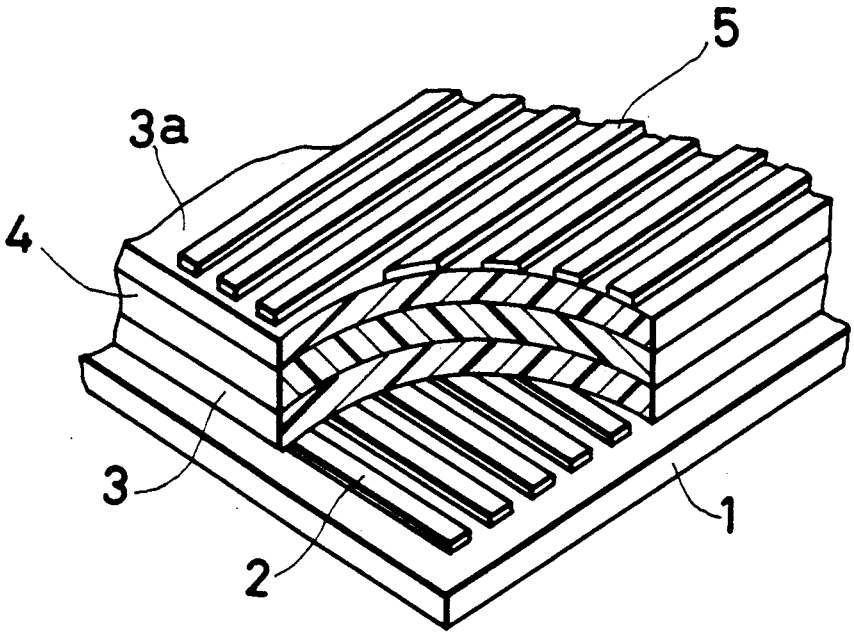
FIG. 1 is a partially cutaway view in perspective of a thin-film EL element.

Now referring to the drawing, preferred embodiments of the invention are described below.

Figure 4:
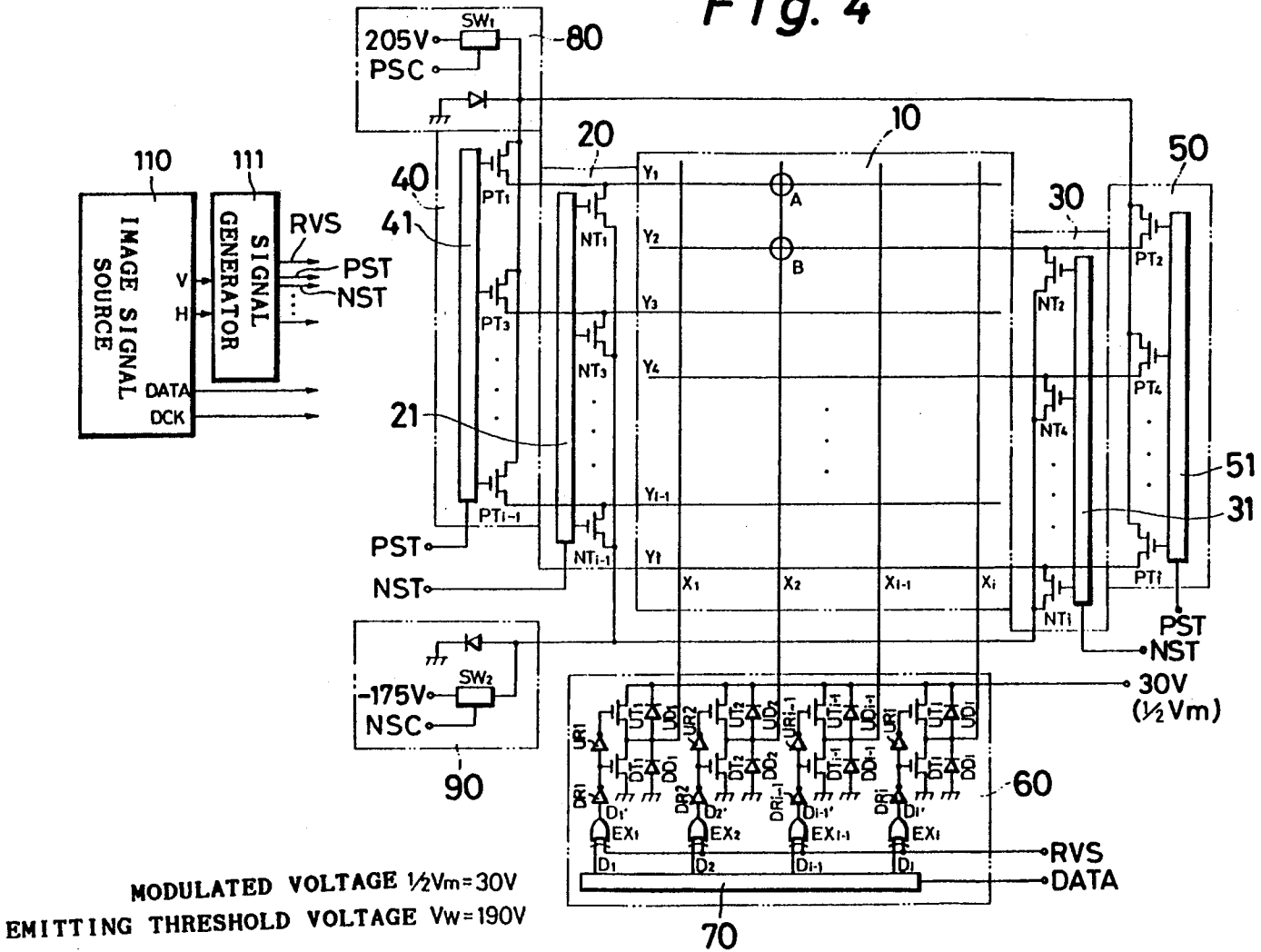
FIG. 4 is a circuit diagram showing the configuration of a thin-film EL display device employing a driving method in accordance with one embodiment of the invention.

FIG. 4 is a circuit diagram showing a rough configuration of a display device employing a driving method in accordance with one embodiment of the invention. This display device is a thin-film EL display device having a display panel 10 constructed with a thin-film EL element having an emitting threshold voltage Vw (=190 V). In the diagram, only electrodes are shown for the display panel 10 in which data-side electrodes are arranged in the X direction and scanning-side electrodes are arranged in the Y direction.

Scanning-side n-channel high voltage MOS driver ICs 20 and 30 are pull-down driver circuits for the scanning-side electrodes on the even-numbered and odd-numbered lines respectively, and comprise n-channel MOS transistors NT1–NTi, which are pull-down switching elements, and logic circuits 21 and 31 which comprise shift registers, etc.

Scanning-side p-channel high voltage MOS driver ICs 40 and 50 are pull-up driver circuits for the scanning-side electrodes on the odd-numbered and even-numbered lines respectively, and comprise p-channel MOS transistors PT1–PTi, which are pull-up switching elements, and logic circuits 41 and 51 which comprise shift registers, etc.

A data-side driver IC 60 is a push-pull driver circuit for the data-side electrodes, which comprises transistors UT1–UTi having a pull-up function with one terminal thereof connected to a power supply side of $\frac{1}{2}$Vm (=30 V); transistors DT1–DTi having a pull-down function with one terminal thereof grounded; diodes UD1–UDi, DD1–DDi for flowing currents in the reverse direction from that of the transistors; a logic circuit 70 comprising a shift register, etc. for controlling the switching of the transistors; data inversion control circuits EX1–EXi; and inverting circuits UR1–URi, DR1–DRi.

The data inversion control circuits EX1–EXi comprise exclusive OR gates, etc. by which display data signals D1–Di output from the logic circuit 70 for controlling the switching of the transistors UT1–UTi, DT1–DTi are inverted in response to a control signal RVC for conversion into signals D1′–Di′. That is, when the control signal RVC is high level, the data inversion control circuits EX1–EXi invert the data signals D1–Di and output them as signals D1′–Di′. On the other hand, when the control signal RVC is low level, the data inversion control circuits EX1–EXi directly output the supplied data signals D1–Di as output signals D1′–Di′ without inverting them.

A source potential switching circuit 80 is a circuit comprising such components as a switch SW1 operated by a control signal PSC, by which the source potential for all p-channel MOS transistors PT1–PTi in the scanning-side p-channel high voltage MOS driver ICs 40, 50 is switched between a positive polarity write voltage Vw+$\frac{1}{4}$Vm (=205 V) and a voltage of 0 V.

A source potential switching circuit 90 is a circuit comprising such components as a switch SW2 operated by a control signal NSC, by which the source potential for all n-channel MOS transistors NT1–NTi in the scanning-side n-channel high voltage MOS driver ICs 20, 30 is switched between a negative polarity write voltage −(Vw−$\frac{1}{4}$Vm) (=−175 V) and a voltage of 0 V.

Figure 5:
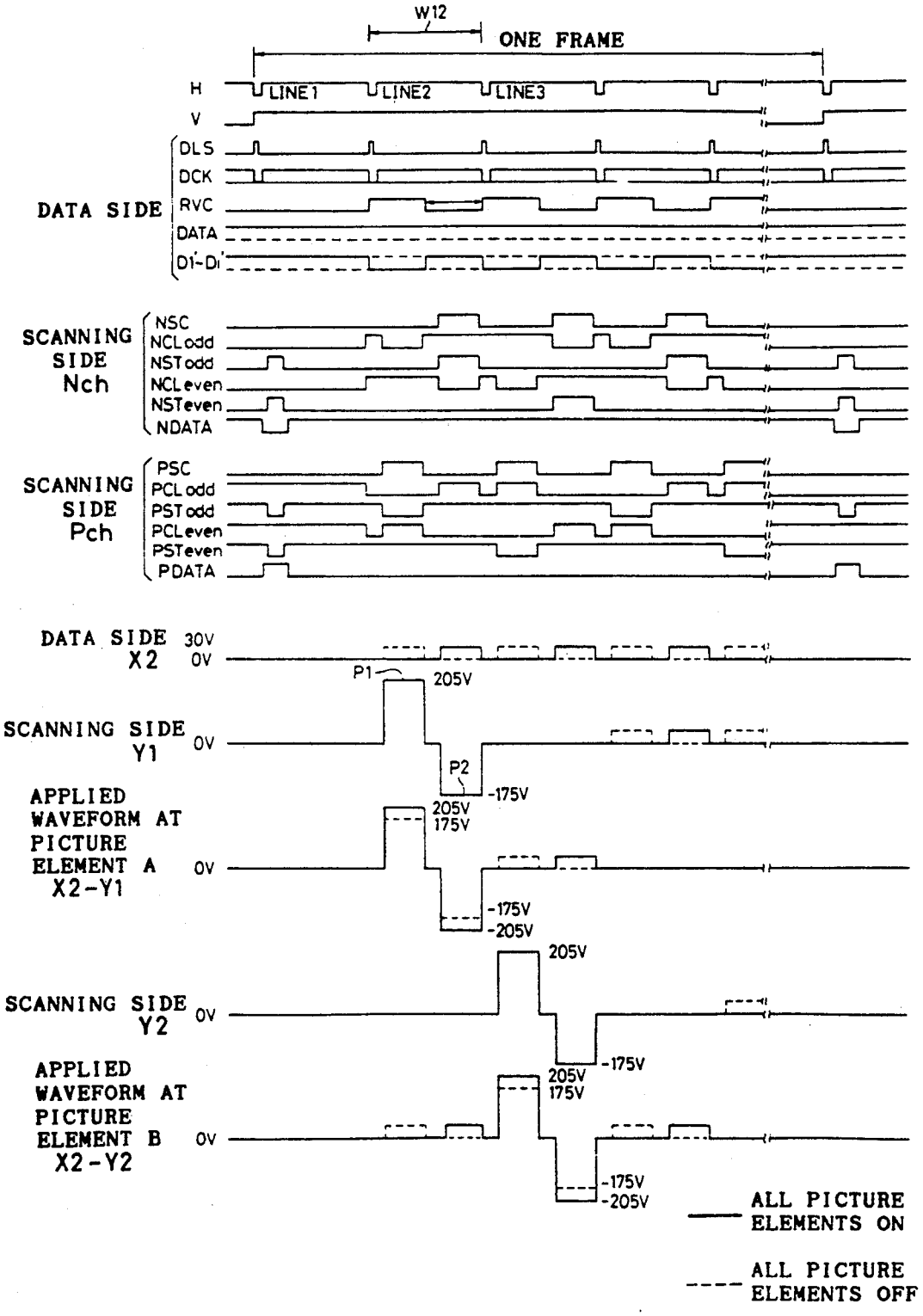
FIG. 5 is a timing chart explaining the operation of the thin-film EL display device.

FIG. 5 is a timing chart explaining the operation for driving a picture element A on a scanning-side electrode Y1 and a picture element B on a scanning-side electrode Y2 in the display panel 10 of the thin-film EL display device. With reference to this timing chart, we will now describe how the picture elements A and B are driven. In the following description, the driving of one scanning line during which the positive polarity write voltage Vw+$\frac{1}{4}$Vm is applied to the scanning-side electrode is referred to as the P driving, and the driving of one scanning line during which the negative polarity write voltage −(Vw−$\frac{1}{4}$Vm) is applied to the scanning-side electrode is referred to as the N driving.

In the timing chart of FIG. 5, the reference sign H indicates the waveform of a horizontal synchronizing signal, and the high level period of the waveform is a data valid period. The reference sign V indicates the waveform of a vertical synchronizing signal at the rising of which the driving for one frame is initiated. The reference sign DLS indicates the waveform of a data latch signal which is output upon completion of the operation of transmitting data for one scanning line in synchronism with a data transmit clock DCK. The reference sign RVC indicates the waveform of a data inverting signal, which goes high level during the P driving period to invert all display data signals D1–Di output from the logic circuit 70 during that period. The reference sign DATA indicates a display data signal, and the reference signs D1'–Di' indicate data signals to be input to the transistors UT1–UTi, DT1–DTi in the data-side driver IC. Other signals are described in Table 1.

Figure 3:
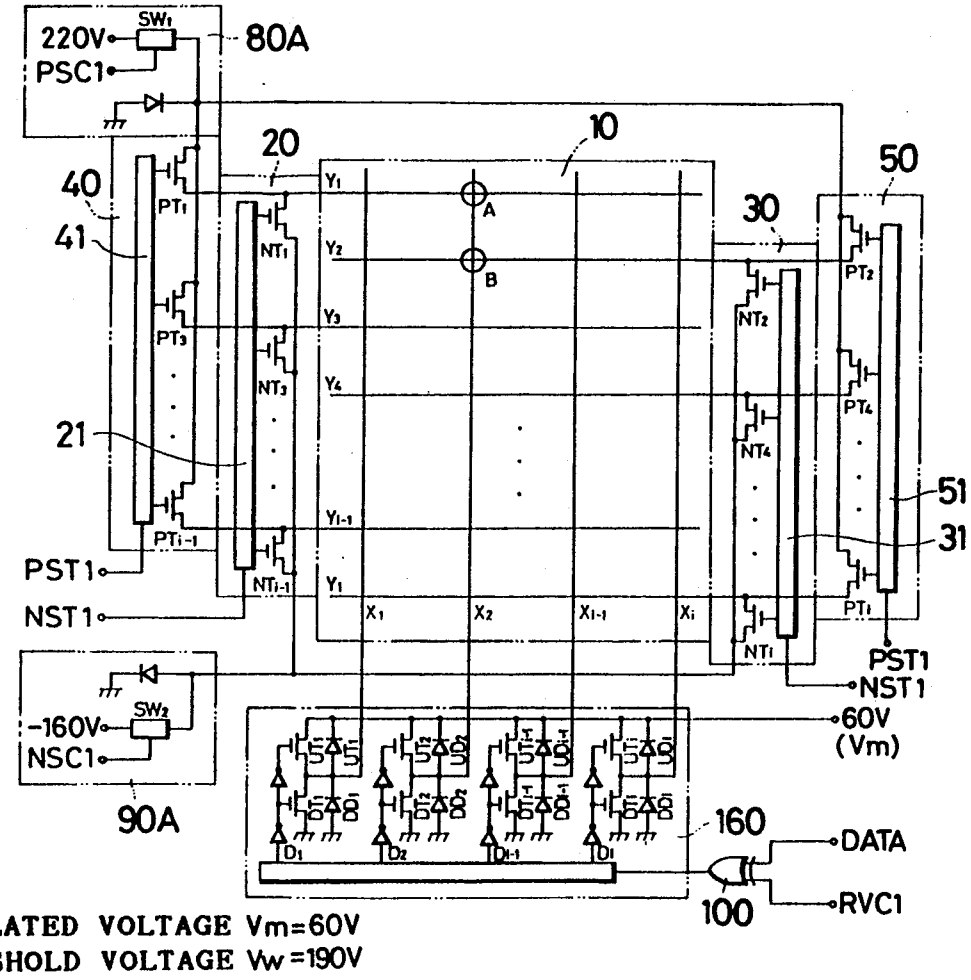
Fig. 3 Prior Art
FIG. 3 is a circuit diagram showing the configuration of a thin-film EL display device employing a prior art driving method.

The signals RVC, PST, NST, . . . are created in a signal generating circuit 111 in synchronism with the horizontal synchronizing signal H and the vertical synchronizing signal V supplied from an image signal source 110 that generates the display data DATA and the data transmit clock DCK. In the prior art of FIG. 3, corresponding signals are designed by like reference signs but suffixed with "1". These signals are analogous to but different from the signals of this embodiment.

During the period W12 in which a write voltage is applied to the scanning electrode Y, the polarity of the voltage applied between the scanning-side electrode Y1 and the data-side electrode X2 is set positive, as shown by the reference sign P1 in FIG. 5, and then negative, as shown by the reference sign P2, thus reversing the polarity once, for example, to drive the picture element A for light emission. The time period W12 as illustrated in FIG. 5 corresponds to the time it takes to scan a single scanning electrode, e.g. electrode Y1; however, the time period W12 is not necessarily limited to the time required to scan a single scanning electrode. When the positive polarity write voltage P1 is being applied, the data-side electrode X2 is set at O V, and when the negative polarity voltage P2 is being applied to the scanning-side electrode Y1, the data-side electrode X2 is set at +30 V. Thus, when the positive polarity voltage P1 or the negative polarity voltage P2 is applied to the scanning-side electrode Y1, a voltage exceeding the emitting threshold voltage of the EL is applied to the picture element A to cause it to emit light.

In this embodiment, since the polarity is reversed once, from the positive polarity P1 to the negative polarity P2, the desired brightness can be obtained even with a relatively low voltage of 30 V applied to the data-side electrode X2. Thus, by setting the voltage at the data-side electrode X2 as low as 30 V as described above, it is possible to reduce the modulation power while achieving the desired brightness with such a low voltage. It is also possible to enhance the brightness by increasing the modulated voltage at the data-side electrode.

Furthermore, since the desired brightness can be obtained without increasing the frequencies of the horizontal synchronizing signal H and vertical synchronizing signal V, there is no need to vary the circuit configuration because of the change in the synchronizing signals H and V. The modulated voltage and the write voltage are set with reference to the ground potential, such as the chassis of the display device, as 0 V.

The control signal RVC is set high level during the first half period W1 of the period W12 and low level during the second half period W2 thereof (W12=W1+W2).

TABLE 1

| | |
|---|---|
| NSC | Control signal for the source potential switching circuit 90 |
| NCLodd | Clear signal for the n-channel high voltage MOS driver IC 20 for odd-numbered lines |
| NSTodd | Strobe signal for the n-channel high voltage MOS driver IC 20 for odd-numbered lines |
| NCLeven | Clear signal for the n-channel high voltage MOS driver IC 30 for even-numbered lines |
| NSTeven | Strobe signal for the n-channel high voltage MOS driver IC 30 for even-numbered lines |
| NDATA | Transmit data for the n-channel high voltage MOS driver ICs 20, 30 |
| PSC | Control signal for the source potential switching circuit 80 |
| PSCodd | Clear signal for the p-channel high voltage MOS driver IC 40 for odd-numbered lines |
| PSTodd | Strobe signal for the p-channel high voltage MOS driver IC 40 for odd-numbered lines |
| PCLeven | Clear signal for the p-channel high voltage MOS driver IC 50 for even-numbered lines |
| PSTeven | Strobe signal for the p-channel high voltage MOS driver IC 50 for even-numbered lines |
| PDATA | Transmit data for the p-channel high voltage MOS driver ICs 40, 50 |
| CLOCK | Scanning-side data transmit clock |

In principle, the driving of the data side is accomplished by switching the modulated voltage applied to the data-side electrodes X1–Xi between ½ Vm (=30 V) and 0 V according to the display data at cycles of one horizontal period. That is, the modulated voltage ½ Vm is at half the modulated voltage Vm (=60 V) required in the previously described prior art driving method. The display data is high level for emission of light and low level for non-emission of light.

The switching timing of the modulated voltage will now be described with reference to FIG. 6(*a*).

Figure 6A:
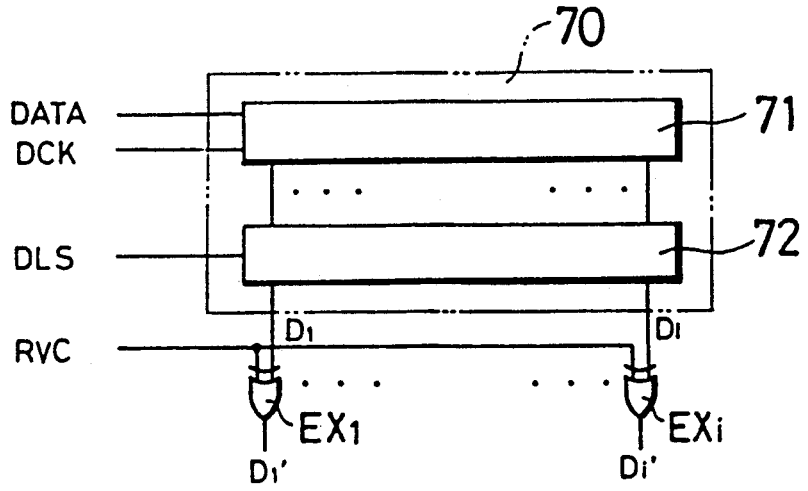
FIGS. 6(*a*) to (*c*) are circuit diagrams showing the configurations of logic circuits used in the thin-film EL display device.
Figure 6B:
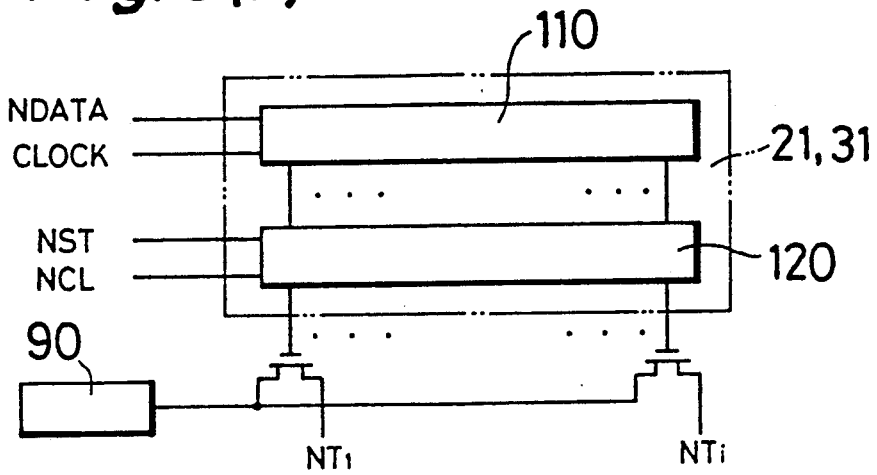
Figure 6C:
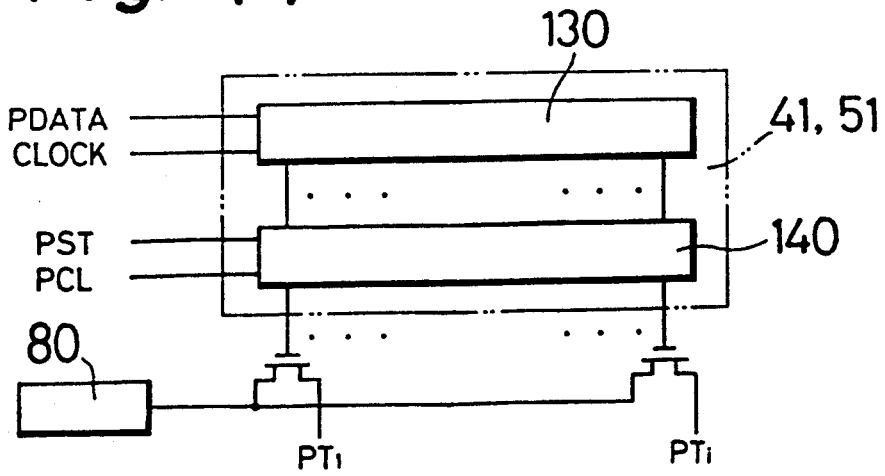

FIG. 6 (*a*) shows the internal configuration of the logic circuit 70. In the logic circuit 70, when one scanning line is being driven, the display data DATA for the next scanning line is supplied, in synchronism with the data transmit clock DCK, to a shift register 71 having a storage capacity of one line. The data stored in the shift register 71 is transferred to a latch circuit 72 in response to the signal DLS input upon completion of data transmission for one line, and is held in the latch circuit 72 until the end of the driving timing. The display data signals D1–Di output from the latch circuit 72 are XORed with the control signal RVC to produce the outputs D1'–Di' in accordance with which the switching of the transistors UT1–UTi, DT1–DTi' is controlled. As a result, the voltage applied to the data-side electrodes X1–Xi is switched at cycles of one horizontal period for every input of the control signal RVC during the horizontal period.

The control signal RVC input to the data inversion control circuits EX1–EXi is high level during the P driving period and is used to output D1'–Di' by inverting the display data signals D1–Di input to the data inversion control circuits EX1–EXi during that period. The display data signals D1–Di are inverted during the P driving for the following reason.

As will be described later, during the P driving, the transistors in the p-channel high voltage MOS driver ICs 40 and 50 are turned on so that the potential at the selected scanning-side electrode Y is raised to Vw+¼ Vm while the potential at the selected data-side electrode X, that is, the data-side electrode X containing the picture element to be driven for light emission, is set at 0 V. As a result, a voltage of (Vw+¼ Vm) is applied to the picture element at the intersection of the selected scanning-side electrode Y and selected data-side electrode X to cause the picture element to emit light. The voltage applied to the picture element is given by:

$$Vw+\tfrac{1}{4}\,Vm=190\ V+\tfrac{1}{4}\times 60\ V=205\ V \quad (9)$$

During that period, the potential at the non-selected data-side electrodes X, that is, the data-side electrodes X containing picture elements not driven for light emission, is set at ½ Vm (=30 V), so that a voltage of (Vw+¼ Vm)−½ Vm is applied to the picture elements at intersections of the non-selected data-side electrodes X and the selected scanning-side electrode Y. The voltage applied to the picture elements is given by:

$$Vw+\tfrac{1}{4}\,Vm-\tfrac{1}{2}\,Vm=Vw-\tfrac{1}{4}\,Vm=190\ V-\tfrac{1}{4}\times 60\ V=175\ V \quad (10)$$

Thus, the applied voltage is below the emitting threshold voltage; therefore, the picture elements are not caused to emit light.

To accomplish such driving, the transistor UTn connected to the selected data-side electrode Xn is turned off, and the transistor DTn connected thereto is turned on. On the other hand, the transistor UTm connected to the non-selected data-side electrode Xm is turned on, and the transistor DTm connected thereto is turned off. This requires input data Dn corresponding to the selected data-side electrode Xn to be set low level and input data Dm corresponding to the non-selected data-side electrode Xm to be set high level. These levels are the reverse of the levels of the display data DATA input to the data inversion control circuits EX1–EXi. Accordingly, the control signal RVC is required for inverting the display data signals D1–Di.

The waveform applied to the data-side electrode X2 during the above driving is shown as data-side X2 in FIG. 5.

Next, the driving of the scanning side is described with reference to FIGS. 6(*b*) and (*c*).

FIG. 6(*b*) shows the internal configuration of the logic circuits 21, 31 in the n-channel high voltage MOS driver ICs 20, 30, and FIG. 6(*c*) shows the internal configuration of the logic circuits 41, 51 in the p-channel high voltage MOS driver ICs 40, 50. The truth table for the logic circuits in the n-channel high voltage MOS driver ICs 20, 30 is shown in Table 2 , and the truth table for the logic circuits in the p-channel high voltage MOS driver ICs 40, 50 is shown in Table 3.

TABLE 2

| NDATA | NCL | NST | TRANSISTOR |
|---|---|---|---|
| X | L | X | OFF |
| X | H | L | ON |
| L | H | H | ON |
| H | H | H | OFF |

TABLE 3

| PDATA | PCL | PST | TRANSISTOR |
|---|---|---|---|
| X | H | X | OFF |
| X | L | H | ON |
| H | L | L | ON |
| L | L | L | OFF |

The n-channel high voltage MOS driver ICs 20, 30 and the p-channel high voltage MOS driver ICs 40, 50 are complementary to each other. Their logic levels are opposite to each other, but they employ the same configuration. Therefore, the description below deals only with the n-channel high voltage MOS driver ICs 20, 30.

A shift register 110 is a circuit for storing a selected scanning line and has the function to receive the transmit data NDATA during the high level period of the clock signal CLOCK and output the data NDATA during the low level period of the clock signal CLOCK. In the thin-film EL display device of this embodiment, the signals NSTodd and NSTeven shown in FIG. 5 are each used as the clock signal CLOCK and are input to the odd-number n-channel high voltage MOS driver IC 20 and the even-number n-channel high voltage MOS driver IC 30, respectively.

As the transmit data NDATA, a signal is input which goes low level only once during one frame period, that is, only during the high level period of the first clock signals NSTodd, NSTeven input after the rising of the vertical synchronizing signal V, as shown in FIG. 5. Thus, the clock signals NSTodd, NSTeven each are input once for every two horizontal periods because the N driving is performed in line sequential fashion with the odd-numbered scanning lines alternating with the even-numbered ones, such as Y1 (odd-numbered line), Y2 (even-numbered line), Y3 (odd-numbered line), and so on.

A logic circuit 120 is a circuit which uses two input signals NST and NCL for switching the transistors NT1–NTi in the n-channel high voltage MOS driver ICs 20, 30 between three states according to the data from the shift register 110. Its logic is based on the truth table of Table 2. The above operation is summarized in Table 4.

TABLE 4

| Selected line | Odd-numbered line | | | | Even-numbered line | | | |
|---|---|---|---|---|---|---|---|---|
| Driving mode | Pch | | Nch | | Pch | | Nch | |
| Timing | Modulate | Write | Modulate | Write | Modulate | Write | Modulate | Write |
| N-ch source potential | 30 V | 30 V | 30 V | −175 V | 30 V | 30 V | 30 V | −175 V |
| P-ch source potential | 30 V | 205 V | 30 V | 30 V | 30 V | 205 V | 30 V | 30 V |
| NSC | OFF | OFF | OFF | ON | OFF | OFF | OFF | ON |
| PSC | OFF | ON | OFF | OFF | OFF | ON | OFF | OFF |
| NTodd | ON | OFF | ON | (ON) | ON | ON | ON | OFF |
| NTeven | ON | ON | ON | OFF | ON | OFF | ON | (ON) |
| PTodd | ON | (ON) | ON | OFF | ON | OFF | ON | ON |
| PTeven | ON | OFF | ON | ON | ON | (ON) | ON | OFF |
| NCLodd | H | L | H | H | H | H | H | L |
| NSTodd | L | L | L | H | L | L | L | L |
| NCLeven | H | H | H | L | H | L | H | H |
| NSTeven | L | L | L | L | L | L | L | H |
| PCLodd | L | L | L | H | L | H | L | L |
| PSTodd | H | L | H | H | H | H | H | H |

TABLE 4-continued

| | | | | | | | | |
|---|---|---|---|---|---|---|---|---|
| PCLeven | L | H | L | L | L | L | L | H |
| PSTeven | H | H | H | H | H | L | H | H |

As shown, the operation of the thin-film EL display device is such that both the P driving and the N driving are performed on each line-sequentially selected scanning line, thereby closing an AC pulse required for light emission of each picture element. The N driving and the P driving each consist of a modulation period and a write period. The modulation period is about 10 μsec. and the write period is 30 μsec., thus providing one horizontal period of about 80 μsec.

The N-ch source potential and the P-ch source potential shown in Table 4 are the source potentials for transistors of the n-channel high voltage MOS driver ICs 20, 30 and the p-channel high voltage MOS driver ICs 40, 50, respectively, which are required to apply a perfectly symmetrical AC waveform of the amplitude that can cause the picture elements to emit light in the NP and PN fields.

The signal NSC is a control signal for the source potential switching circuit 90 for the n-channel high voltage MOS driver ICs 20, 30. When this signal is high level, that is, when the switch SW2 in the source potential switching circuit 90 is ON, the source potential is $-(Vw-\frac{1}{4}Vm)(=-175\ V)$, and when the switch SW2 is OFF, the source potential is 0 V.

The signal PSC is a control signal for the source potential switching circuit 80 for the p-channel high voltage MOS driver ICs 40, 50. When this signal is high level, that is, when the switch SW1 in the source potential switching circuit 80 is ON, the source potential is $Vw+\frac{1}{4}Vm$ (=205 V), and when the switch SW1 is OFF, the source potential is 0 V.

In Table 4, "NTodd" indicates the transistors in the driver IC 20, "NTeven" the transistors in the driver IC 30, and "PTodd" the transistors in the driver IC 40. "ON/OFF" means the ON/OFF operation of each of these transistors in each timing. However, "(ON)" means that only the transistors for the selected scanning line are turned on. The ON/OFF/(ON) operations of these transistors are controlled by the signals NCLodd, NSTodd, NCLeven, NSTeven, PCLodd, PSTodd, PCLeven, and PSTeven. Their logic levels in each timing are shown in Table 4.

During the modulation period, the switches SW1 and SW2 are turned off by the signals NSC and PSC respectively, all the transistors in the scanning-side driver ICs 20, 30, 40 and 50 are turned on, and the potential for all the scanning-side electrodes Y is set at 0 V. At this time, a modulated voltage of $\frac{1}{2}Vm$ (=30 V) or 0 V is applied to each data-side electrode X according to the display data DATA. As a result, of the data-side electrodes X, the electrodes supplied with the modulated voltage $\frac{1}{2}Vm$ (=30 V) place on the picture elements a positive voltage of $\frac{1}{2}Vm$ (=30 V) with reference to the scanning-side electrodes Y, the transistors in the n-channel high voltage MOS driver ICs 20, 30 serving as the charge paths, while on the other hand, the electrodes supplied with the modulated voltage 0 V are held at the potential of 0 V with reference to the scanning-side electrodes Y.

Thus, during the modulation period, the modulated voltage applied to each data-side electrode X is set at either 0 V or $\frac{1}{2}Vm$ (=30 V) according to the display data DATA, while 0 V is applied to all the scanning-side electrodes Y, as a result of which the potential for each data-side electrode X is either charged to $\frac{1}{2}Vm$ (=30 V) or held at 0 V with reference to the scanning-side electrodes Y. Also, the polarity is reversed between the N driving and the P driving even for the same display data signals D1–Di because of the operation of the data inversion control circuits Ex1–Exi in response to the signal RVC. Therefore, by performing the P driving and the N driving alternately, a perfectly symmetrical alternating current waveform can be obtained for the voltage applied to each picture element.

Next, the operations of the four kinds of write periods are described with reference to the equivalent circuits shown in FIGS. 7 to 10.

(1) Write period of odd-numbered scanning electrodes by P driving

The signal NSC is set low level to turn off the switch SW2 so that the source potential of the transistors in the n-channel high level voltage MOS driver ICs 20, 30 is set at 0 V, and the signal PSC is set high to turn on the switch SW1 so that the source potential of the transistors in the p-channel transistors 40, 50 is set at $Vw+\frac{1}{4}Vm$ (=205 V). Also, to select an odd-numbered scanning line, the transistor connected to that scanning line is selected from the transistors PTodd in the p-channel high voltage MOS driver IC 40 according to the data from the shift register in the logic circuit 41, and the selected transistor is turned on while the transistors connected to the other scanning lines are turned off. At this time, the transistors PTeven and NTodd are all turned off, and the transistors NTeven are all turned on. On the other hand, for the data-side electrodes X, the driving of the modulation period is continued.

Figure 7A:
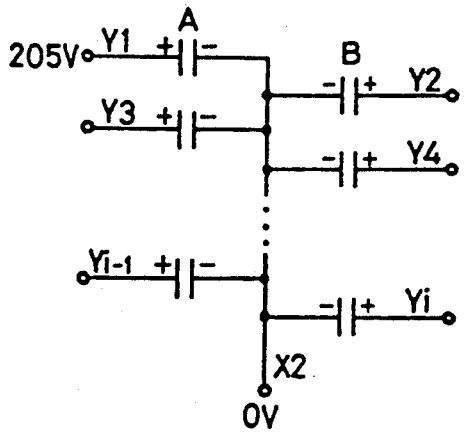
FIGS. 7 to 10 are circuit diagrams showing the equivalent circuits of the display panel of the thin-film EL display device in operating conditions.
Figure 7B:
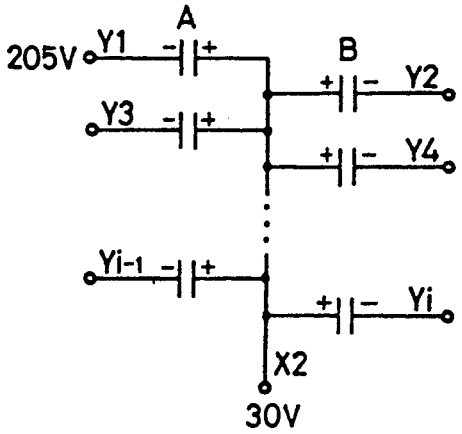

FIGS. 7(*a*) and (*b*) show the equivalent circuits of the display panel 10 in the above condition. The equivalent circuit shown in FIG. 7(*a*) is the one when the picture element A is driven for light emission. As shown, a negative polarity voltage given by the following equation is applied to the data-side electrode X2 with reference to the scanning-side electrode Y1 so that only the picture element A at the intersection of the data-side electrode X2 and the selected scanning-side electrode Y1 is caused to emit light.

$$0V-(Vw+\tfrac{1}{4}Vm)=0V-205V=-205V \quad (11)$$

FIG. 7(*b*) shows the equivalent circuit when the picture element A is not driven to emit light. The voltage applied to the picture element A at this time is given by:

$$\tfrac{1}{2}Vm-(Vw+\tfrac{1}{4}Vm)=30V-205V=-175V \quad (12)$$

Since the applied voltage is below the emitting threshold voltage 190 V, the picture element A is not caused to emit light.

(2) Write period of odd-numbered scanning electrodes by N driving

The signal NSC is set high level to turn on the switch SW2 so that the source potential of the transistors in the n-channel high voltage MOS driver ICs 20, 30 is set at $-(Vw-\frac{1}{4}Vm)$ (=−175 V), and the signal PSC is set low level to turn off the switch SW1 so that the source potential of the transistors in the p-channel transistors 40, 50 is set at 0 V. Also, to select an odd-numbered scanning line, the transistor connected to that scanning line is selected from the transistors NTodd in the n-channel high voltage MOS driver IC 20 according to the data from the shift register in the logic circuit 21, and the selected transistor is turned on while the transistors connected to the other scanning lines are turned off. At this time, the transistors NTeven and PTodd are all turned off, and the transistors PTeven are all turned on. On the other hand, for the data-side electrodes X, the driving of the modulation period is continued.

Figure 8A:
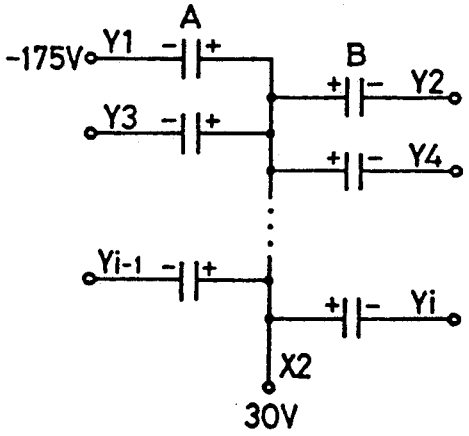
Figure 8B:
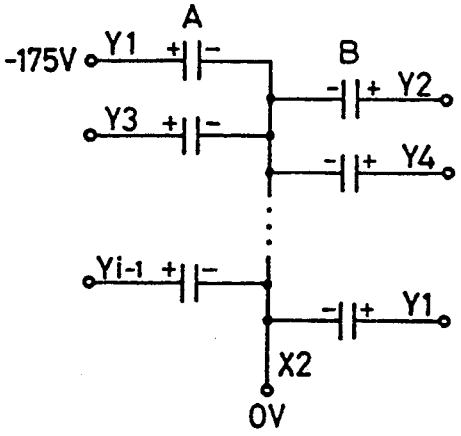

FIGS. 8(*a*) and (*b*) show the equivalent circuits of the display panel 10 in the above condition. The equivalent circuit shown in FIG. 8(*a*) is the one when the picture element A is driven for light emission. As shown, a positive polarity voltage given by the following equation is applied to the data-side electrode X2 with reference to the scanning-side electrode Y1 so that only the picture element A at the intersection of the data-side electrode X2 and the selected scanning-side electrode Y1 is caused to emit light.

$$\tfrac{1}{2}Vm-(-(Vm-\tfrac{1}{4}Vm))=30V-(-175V)=205V \quad (13)$$

It should be noted that the voltage applied at this time is 15 volts lower than the applied voltage of 220 V in the case of the prior art driving method shown by the equation (3). That is, in the prior art, the voltage value required to exceed the emitting threshold voltage of 190 V was 30 V, but in this embodiment, the voltage is reduced to 15 V, one half of the previous value.

FIG. 8(*b*) shows the equivalent circuit when the picture element A is not driven to emit light. The voltage applied to the picture element A at this time is given by:

$$0V-(-(Vw-\tfrac{1}{4}Vm))=0V-(-175V)=175V \quad (14)$$

Since the applied voltage is below the emitting threshold voltage 190 V, the picture element A is not caused to emit light.

(3) Write period of even-numbered scanning electrodes by P driving

The signal NSC is set high level to turn on the switch SW2 so that the source potential of the transistors in the n-channel high voltage MOS driver ICs 20, 30 is set at 0 V, and the signal PSC is set high level to turn on the switch SW1 so that the source potential of the transistors in the p-channel transistors 40, 50 is set at $Vw+\frac{1}{4}Vm$ (=205 V). Also, to select an even-numbered scanning line, the transistor connected to that scanning line is selected from the transistors PTeven in the p-channel high voltage MOS driver IC 50 according to the data from the shift register in the logic circuit 51, and the selected transistor is turned on while the transistors connected to the other scanning lines are turned off. At this time, the transistors PTodd and NTeven are all turned off, and the transistors NTodd are all turned on. On the other hand, for the data-side electrodes X, the driving of the modulation period is continued.

Figure 9:
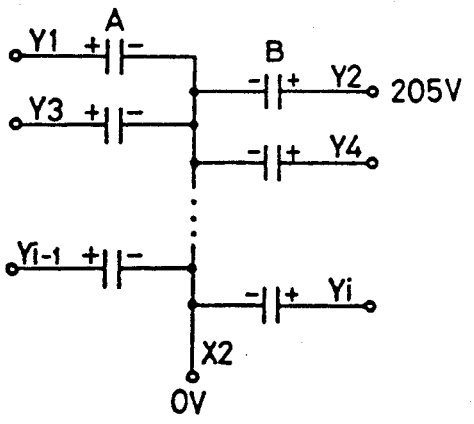
Figure 9:
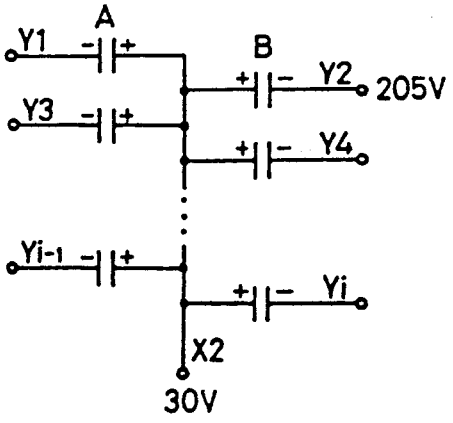

FIGS. 9(*a*) and (*b*) show the equivalent circuits of the display panel 10 in the above condition. The equivalent circuit shown in FIG. 9(*a*) is the one when the picture element B is driven for light emission. As shown, a positive polarity voltage given by the following equation is applied to the data-side electrode X2 with reference to the scanning-side electrode Y2 so that only the picture element B at the intersection of the data-side electrode X2 and the selected scanning-side electrode Y2 is caused to emit light.

$$(Vw+\tfrac{1}{4}Vm)-0V=205V-0V=205V \quad (15)$$

FIG. 9(*b*) shows the equivalent circuit when the picture element B is not driven to emit light. The voltage applied to the picture element B at this time is given by:

$$(Vw+\tfrac{1}{4}Vm)-\tfrac{1}{2}Vm=205V-30V=175V \quad (16)$$

Since the applied voltage is below the emitting threshold voltage 190 V, the picture element B is not caused to emit light.

(4) Write period of even-numbered scanning electrodes by N driving

The signal NSC is set high level to turn on the switch SW2 so that the potential of the transistors in the n-channel high voltage MOS driver ICs 20, 30 is set at $-(Vw-\frac{1}{4}Vm)$ (= −175 V), and the signal PSC is set low level to turn off the switch SW1 so that the potential of the transistors in the p-channel transistors 40, 50 is set at 0 V. Also, to select an even-numbered scanning line, the transistor connected to that scanning line is selected from the transistors NTeven in the n-channel high voltage MOS driver IC 30 according to the data from the shift register in the logic circuit 31, and the selected transistor is turned on while the transistors connected to the other scanning lines are turned off. At this time, the transistors NTodd and PTeven are all turned off, and the transistors PTodd are all turned on. On the other hand, for the data-side electrodes X, the driving of the modulation period is continued.

Figure 10:
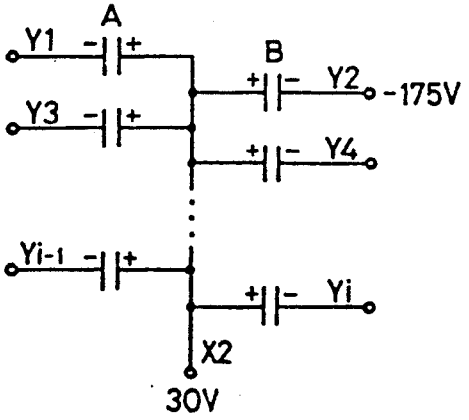
Figure 10:
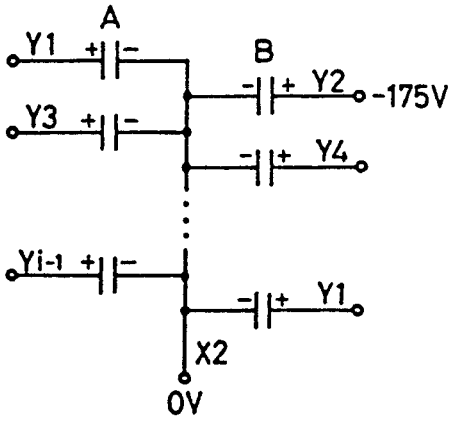

FIGS. 10(*a*) and (*b*) show the equivalent circuits of the display panel 10 in the above condition. The equivalent circuit shown in FIG. 10(*a*) is the one when the picture element B is driven for light emission. As shown, a positive polarity voltage given by the following equation is applied to the data-side electrode X2 with reference to the scanning-side electrode Y2 so that only the picture element B at the intersection of the data-side electrode X2 and the selected scanning-side electrode Y2 is caused to emit light.

$$\tfrac{1}{2}Vm-(-(Vw-\tfrac{1}{4}Vm))=30V+175V=205V \quad (17)$$

Fig. 10(*b*) shows the equivalent circuit when the picture element B is not driven to emit light. The voltage applied to the picture element B at this time is given by:

$$0V-(-(Vw-\tfrac{1}{4}Vm))=0V+175V=175V \quad (18)$$

Since the applied voltage is below the emitting threshold voltage 190 V, the picture element B is not caused to emit light.

Figure 2:
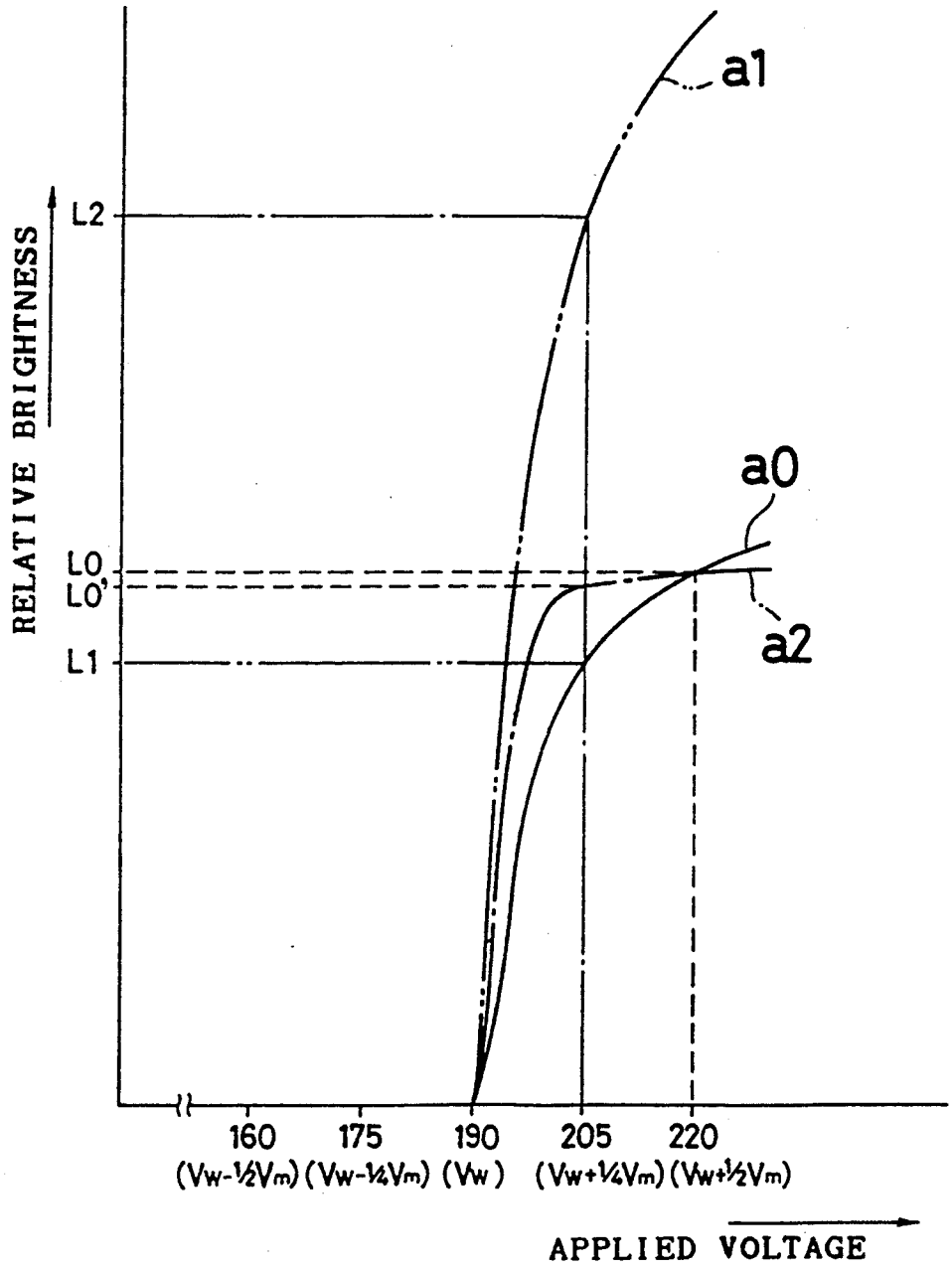
FIG. 2 is a graph showing the voltage-to-brightness characteristics of the thin film EL element.

In FIG. 2, the voltage $Vw+\frac{1}{4}Vm$ (=205 V) applied in the above driving modes to the picture elements for light emission and the voltage $Vw-\frac{1}{4}Vm$ (=160 V ) applied to the picture elements not driven for light emission are marked alongside of the corresponding voltage values on the x-axis along which the applied voltage is plotted.

As described, according to the driving method of this embodiment, the modulated voltage applied to the data-side electrodes X is reduced to one half of the modulated voltage Vm (=60 V) applied by the prior art driving method, that is, to ½Vm (=30 V). As a result, if the number of light emissions per unit time, i.e. the light emitting duty, is the same as in the case of the prior art driving method, the brightness L1 of the illuminating picture element of this embodiment will drop significantly as compared with the brightness L0 achieved by the prior art driving method, as shown by the voltage-to-brightness characteristic curve indicated by a0 in Fig. 2 of the thin-film EL display device.

Therefore, to compensate for the above drop in light emission brightness, this embodiment is so configured that each picture element is driven at twice the rate of the prior art method without changing the frequencies of the externally supplied synchronizing signals H and V.

In FIG. 2, the reference sign al indicates the voltage-to-brightness characteristic curve of this embodiment when the number of light emissions per unit time is set, as described above, at twice that of the prior art driving method. In this embodiment, since the voltage applied to drive each picture element for light emission is Vw+¼Vm (=205 V), the resulting light emission brightness L2 is higher than the light emission brightness L0 achieved by the prior art method.

That is, when the capacitance of the display panel is denoted as C and the number of times to apply the modulated voltage Vm to the data-side electrodes X in unit time is denoted as f, the modulation power Pm consumed by the charging and discharging of the modulated voltage Vm in the prior art method is given by: $Pm=f\cdot C\cdot Vm^2$ as expressed by the equation (8). In this embodiment, on the other hand, since the modulated voltage is ½Vm, and the number of light emissions per unit time is doubled, i.e. the number of applications of the modulated voltage ½Vm is 2f, the modulation power Pm is given by:

$$Pm=(2f)\cdot C\cdot(\tfrac{1}{2}Vm)^2=\tfrac{1}{2}\cdot f\cdot C\cdot Vm^2 \quad (19)$$

which means the modulation power is reduced to one half of that required in the prior art driving method.

In the prior art driving method, the frame frequency is usually 60-Hz, and the time allocated to one frame is about 16.66 msec. Therefore, supposing the time of 40 μsec. is allocated to each of the N and P driving modes to drive one line of scanning-side electrode Y, it means that about 200 scanning lines can be driven during one frame period. When approximately the same light emission brightness as achieved by the prior art driving method can be obtained without doubling the number of light emissions per unit time as described above, i.e., when the voltage-to-brightness characteristic curve close to a step-like form indicated by a2 in FIG. 2 can be achieved, the number of scanning lines that can be driven during one frame period will further increase.

A possible alternative method to double the number of light emissions per unit time may be to perform the P driving twice on every scanning-side electrode during one frame period followed by the N driving to be performed twice on every scanning-side electrode during the next frame period, but this method is not desirable since the characteristic of the EL display device is such that when a voltage of the same polarity is successively applied, the light emission pulse becomes lower in the second emission than in the first emission, thus resulting in a lower brightness than that achieved by the method of this embodiment.

In the description of this embodiment, the P driving is performed, followed by the N driving, on every scanning line during one frame period, but this sequence of driving may be reversed. Also, the driving sequence may be changed for every scanning line.

Further, in this embodiment, the odd-numbered electrodes other than the selected scanning-side electrode are clamped at 0 V, but they may be held in the floating state.

Figure 11:
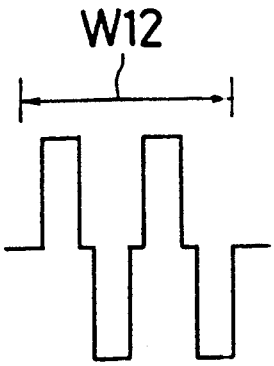
FIG. 11 is a diagram showing the waveform of a voltage applied to a scanning electrode Y1 to drive a picture element A for light emission in another embodiment of the invention.

Also, in the above embodiment, the polarity of the voltage applied to the EL is reversed only once during the period W12, but the EL may be driven by reversing the polarity of the applied voltage two or more times, which constitutes other embodiments of the invention. When, for example, the picture element A is to be driven to emit light, the write voltage applied to the scanning-side electrode Y as shown in FIG. 5 may be modified to provide a waveform shown in FIG. 11 so that the polarity of the voltage applied to the picture element A is reversed three times for the driving thereof. At this time, the modulated voltage for the data-side electrode X2 is varied according to the variation of the voltage applied to the scanning-side electrode Y1, as in the case of the foregoing embodiment.

Figure 12:
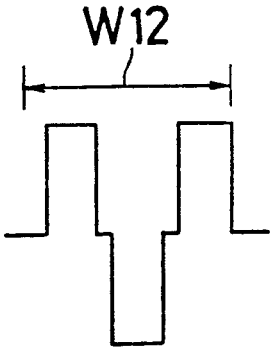
FIG. 12 is a diagram showing the waveform of a voltage applied to the scanning electrode Y1 to drive the picture element A for light emission in still another embodiment of the invention.
Figure 12:
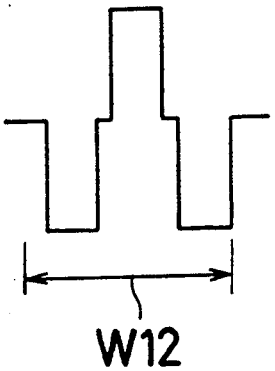

FIG. 12 shows still another embodiment of the invention, in which the voltage waveform shown in FIG. 12(1) is applied to the scanning-side electrode Y1 to drive the picture element A for light emission so that the voltage applied to the picture element A is reversed twice during the period W12. When the voltage waveform of FIG. 12(1) is applied during the scanning of the first frame, the waveform shown in FIG. 12(2), the polarity being reversed from that for the first frame, is applied during the subsequent frame period, thereby reliably achieving the desired brightness. Thus, in the embodiment of FIG. 11, the selected picture element A is caused to emit light a total of four times during the period W12, and in the embodiment of FIG. 12, it is caused to emit light a total of three times during that period.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of driving a display device having a plurality of scanning-side electrodes extending in one direction, a plurality of data-side electrodes extending in a second direction intersecting the first direction, and dielectric layers interposed therebetween, picture elements being formed at intersections of the scanning-side electrodes and data-side electrodes, the picture elements being driven by applying a modulated voltage, the magnitude thereof being varied according to the emission or non-emission of light, to the data-side electrodes, while applying a write voltage in line sequential fashion to alternately divided odd number scanning-side electrodes and even number scanning-side electrodes, so that a voltage including the applied modulated and write voltage exceeding the emitting threshold voltage of the picture element is applied for emission of light and a voltage including the applied modulated and write voltages below the emitting threshold voltage is applied for non-emission of light, the method comprising:

reversing the polarity of the voltage including the modulated and write voltages applied between the data-side electrode and the scanning-side electrode corresponding to the picture element to be driven for light emission, one or more times during a period required to scan a single picture element on the scanning-side electrode.

2. A driving device for a display device having a plurality of scanning-side electrodes, a plurality of data-side electrodes, and dielectric layers interposed therebetween, picture elements being formed at intersections of the scanning-side electrodes and data-side electrodes, comprising:

scanning-side electrode driving means connected to the plurality of odd number scanning-side electrodes and even number scanning-side electrodes for applying a positive or negative polarity write voltage to the scanning-side electrodes;

data-side electrode driving means connected to the plurality of data-side electrodes which, when a picture element on the scanning-side electrode supplied with a write voltage is to be driven for light emission, applies a modulating voltage that cooperates with each write voltage to set a cumulative voltage of the applied modulated and write voltages applied to picture element above a threshold voltage, to the corresponding data-side electrode, and when the picture element is not driven for light emission, applies a modulating voltage, which cooperates with each write voltage to set a cumulative voltage of the applied modulated and write voltages applied to picture element below a threshold voltage, to the corresponding data-side electrode; and display control means for controlling the scanning-side electrode driving means and the data-side electrode driving means and reversing the polarity of said cumulative voltage applied between the data-side electrode and the scanning-side electrode corresponding to the picture element to be driven for light emission, one or more times during the period required to scan a single picture element on the scanning-side electrode.

3. A driving device for a display device as set forth in claim 2, wherein the scanning-side electrode driving means comprising:

odd-numbered electrode driving circuits for applying the write voltage to the odd-numbered scanning-side electrodes; and even-numbered electrode driving circuits for applying the write voltage to the even-numbered scanning-side electrodes.

4. A driving device for a display device as set forth in claim 3, wherein the scanning-side electrode driving means comprises:

a first potential switching circuit for switching the voltage applied to odd-numbered and even-numbered electrode driving circuits between a voltage of positive polarity and a voltage of 0 V; and a second potential switching circuit for switching the voltage applied to odd-numbered and even-numbered electrode driving circuits between a voltage of negative polarity and a voltage of 0 V.

5. A driving device for a display device as set forth in claim 4, wherein the odd-numbered electrode driving circuits comprise:

a first driving circuit for applying the voltage supplied from the first potential switching circuit to the scanning-side electrodes; and a second driving circuit for applying the voltage supplied from the second potential switching circuit to the scanning-side electrodes.

6. A driving device for a display device as set forth in claim 5, wherein the even-numbered electrode driving circuits comprise:

a third driving circuit for applying the voltage supplied from the first potential switching circuit to the scanning-side electrodes; and a fourth driving circuit for applying the voltage supplied from the second potential switching circuit to the scanning-side electrodes.

7. A driving device for a display device as set forth in claim 5, wherein the first driving circuit comprises:

a plurality of p-channel MOS transistors to the drains of which the scanning-side electrodes are connected and to the sources of which the first potential switching circuit is connected; and a first logic circuit to which the gates of the plurality of p-channel MOS transistors are connected and which applies a high level signal to the gate of the p-channel MOS transistor connected to the scanning electrode to be supplied with the write voltage.

8. A driving device for a display device as set forth in claim 5, wherein the second driving circuit comprises:

a plurality of n-channel MOS transistors to the drains of which the scanning-side electrodes are connected and to the sources of which the second potential switching circuit is connected; and a second logic circuit to which the gates of the plurality of n-channel MOS transistors are connected and which applies a high level signal to the gate of the n-channel MOS transistor connected to the scanning electrode to be supplied with the write voltage.

9. A driving device for a display device as set forth in claim 6, wherein the third driving circuit comprises:

a plurality of p-channel MOS transistors to the drains of which the scanning-side electrodes are connected and to the sources of which the first potential switching circuit is connected; and a third logic circuit to which the gates of the plurality of p-channel MOS transistors are connected and which applies a high level signal to the gate of the p-channel MOS transistor connected to the scanning electrode to be supplied with the write voltage.

10. A driving device for a display device as set forth in claim 6, wherein the fourth driving circuit comprises:

a plurality of n-channel MOS transistors to the drains of which the scanning-side electrodes are connected and to the sources of which the second potential switching circuit is connected; and a fourth logic circuit to which the gates of the plurality of n-channel MOS transistors are connected and which applies a high level signal to the gate of the n-channel MOS transistor connected to the scanning electrode to be supplied with the write voltage.

11. A driving device for a display device as set forth in claim 2, wherein the data-side driving means comprises:

a plurality of pull-up switching elements, one each provided for each data-side electrode, for applying the modulated voltage to the data-side electrodes;

a plurality of pull-down switching elements, one each provided for each data-side electrode, for applying the reference voltage of 0 V to the data-side electrodes; and element control circuits for controlling the switching of the pull-up switching elements and pull-down switching elements for every one of the data-side electrodes in such a manner that when either one of the switching elements is on, the other is off.

12. A method according to claim 1, wherein the polarity of the voltage including the applied modulated and write voltages is reversed twice during the period required to scan a single scanning-side electrode.

13. A method according to claim 1, wherein the polarity of the voltage including the applied modulated and write voltages is reversed three times during the period required to scan a single scanning-side electrode.

14. A method according to claim 1, wherein the magnitude of the reversed polarity voltage is substantially constant.

15. A driving device for a display device as set forth in claim 2, wherein the display control means reverses the polarity of the cumulative voltage twice during the period required to scan a single scanning-side electrode.

16. A driving device for a display device as set forth in claim 2, wherein the display control means reverses the polarity of the cumulative voltage three times during the period required to scan a single scanning-side electrode.

17. A driving device according to claim 2, wherein the magnitude of the reversed polarity voltage is substantially constant.

* * * * *